US006932310B1

(12) United States Patent
Diss

(10) Patent No.: US 6,932,310 B1
(45) Date of Patent: Aug. 23, 2005

(54) VINYL SIDING BRACKET AND METHOD OF INSTALLATION

(76) Inventor: Derek F. Diss, 4812 Harvest Cir., Canton, OH (US) 44707

( * ) Notice: Subject to any disclaimer, the term of this patent is extended or adjusted under 35 U.S.C. 154(b) by 0 days.

(21) Appl. No.: 10/688,105

(22) Filed: Oct. 17, 2003

(51) Int. Cl.[7] ..... A47F 5/00

(52) U.S. Cl. ..... 248/301; 52/712; 248/304; 248/339

(58) Field of Search ..... 248/301, 339, 248/304, 316.2, 300, 205.1, 223.41, 224.51, 248/224.61, 229.17; 52/712, 520, 525

(56) References Cited

U.S. PATENT DOCUMENTS

| | | | | | |
|---|---|---|---|---|---|
| 927,722 | A | * | 7/1909 | Frambach | 248/229.17 |
| 3,953,015 | A | | 4/1976 | Taylor et al. | |
| 4,069,636 | A | * | 1/1978 | Kessler | 52/712 |
| 4,314,429 | A | | 2/1982 | Casteel et al. | |
| 4,771,974 | A | * | 9/1988 | Carlson | 248/231.81 |
| D312,038 | S | | 11/1990 | Sachs | |
| 5,174,536 | A | * | 12/1992 | Pelletier et al. | 248/339 |
| 5,275,366 | A | | 1/1994 | Simmons | |
| 5,285,364 | A | * | 2/1994 | Bayer | 362/405 |
| 5,388,802 | A | | 2/1995 | Dougan et al. | |
| 5,509,632 | A | * | 4/1996 | Mesna et al. | 248/301 |
| 5,549,266 | A | | 8/1996 | Mitchell et al. | |
| D373,948 | S | | 9/1996 | Etzel et al. | |
| 5,669,709 | A | | 9/1997 | Adams | |
| 5,794,384 | A | | 8/1998 | Dean et al. | |
| 5,885,024 | A | * | 3/1999 | Zupan et al. | 403/389 |
| 6,289,617 | B1 | | 9/2001 | Snyder | |
| 6,375,137 | B1 | * | 4/2002 | McQuade et al. | 248/205.1 |
| 6,434,853 | B2 | | 8/2002 | Pyburn | |
| 2002/0186562 | A1 | | 12/2002 | Schroetter | |

* cited by examiner

*Primary Examiner*—Ramon O Ramirez
(74) *Attorney, Agent, or Firm*—Sand & Sebolt

(57) ABSTRACT

A one-piece metal bracket having a flat main body terminating in a U-shaped downturned lip at one end for snap-fit engagement within an inverted channel formed in a vinyl siding member generally adjacent the point of attachment of the siding member to a support structure. Ends of the lip edge are radiused to facilitate attachment and removal of the clip to and from the siding member. A second end is formed into a support hook forming an acute angle with the main body for supporting an object thereon. In an alternate embodiment, a series of holes in the main body selectively receive an S-hook for supporting an object on the bracket. The bracket is formed as a one-piece member of stainless steel.

21 Claims, 6 Drawing Sheets

VINYL SIDING BRACKET AND METHOD OF INSTALLATION

BACKGROUND OF THE INVENTION

1. Technical Field

The invention relates to brackets and in particular, to a bracket which is removably snap-fitted beneath vinyl siding for supporting objects thereon. Even more particularly, the invention relates to such a bracket which is easily attached and removed from the vinyl siding and which is able to support various objects by providing several attachment structures.

2. Background Information

Various types of brackets have been designed and developed for use with vinyl siding and similar materials in order to suspend objects from the siding, such as Christmas lights, decorative flowers, and other relatively lightweight objects. However, many of these brackets are difficult to install on the siding and to be removed therefrom without damaging the siding. Other brackets require various types of separate fasteners for securing the brackets on the siding. Some examples of brackets used for vinyl or other types of sidings are shown in U.S. Pat. Nos. 3,953,015; 4,314,429; 5,275,366; 5,388,802; 5,549,266; 5,669,709; 5,794,384; 6,289,617; 6,434,853; U.S. Publication No. 2002/0186562; and in U.S. Design Pat. Nos. D-312,038 and D-373,948. Many of these prior art brackets are relatively expensive to fabricate for mass market sale and distribution, are difficult to install, and may be satisfactory for specific applications, but do not provide for a variety of uses and ease of mounting and removal of the bracket from the siding. Also, many of these prior art brackets are relatively expensive to fabricate due to the numerous forming operations required and the type of materials used therefor.

Therefore, the need exists for an improved bracket which is easily attached to and removed from vinyl siding which is maintenance free, easy to fabricate, and provides for a variety of uses, and is relatively inexpensive to mass produce.

BRIEF SUMMARY OF THE INVENTION

The present invention provides a bracket which is easily fabricated as a one-piece member formed of stainless steel preferably having a gauge of approximately 20, which includes a generally flat body with a downturned lip at one end which is adapted to be engaged by a snap-fit connection with a curved inverted channel formed on overlapped vinyl siding; and in which the edges of the downturned lip have curved ends to provide for and facilitate the installation and removal of the clip on and from the vinyl siding.

Another feature of the invention is to provide the bracket with a supporting end in one embodiment, having an outwardly extending angled leg which forms an acute angle with the main body of the bracket for supporting various types of objects therefrom, in a second embodiment, the main body is formed with a plurality of holes for receiving an S hook or other type of support member, and in a third embodiment the bracket has an adjustable strap secured thereto for supporting other types of objects.

Still another aspect of the invention is to form the bracket of a one-piece stainless steel having a uniform thickness throughout of approximately 0.0355 inches, with an overall length of approximately 4.6 inches, and a width of approximately 1.25 inches thereby making it rust-resistant and providing sufficient stiffness thereto, enabling it to support various objects without deforming and injuring the supporting vinyl siding members.

These features and advantages are obtained by the one-piece bracket of the present invention, the general nature of which may be stated as including a generally flat main body terminating in a first end adapted to snap-fit engage one of the vinyl siding members, and a second end opposite of said first end for receivably supporting an object thereon; said first end being an inverted U-shaped portion having a web extending from the main body and terminating in an attachment leg spaced from and extending generally parallel with the main body, the attachment leg terminating in curved or rounded ends to facilitate attachment of the bracket to one of the siding members; the second end including a hook connected to the main body by a curved portion and extending at an acute angle with respect to the main body for supporting an object thereon; said inverted U-shaped portion of the bracket being complementary to an inverted channel formed in one of the siding members for snap-fit engagement therewith. These features and advantages are further obtained by the method of the present invention which includes the steps of providing a bracket having a main body terminating at one end in a downturned lip, inserting the lip upwardly between a pair of overlapping side members, and snap-fit engaging the lip in a complementary shaped inverted channel formed in one of the siding members.

BRIEF DESCRIPTION OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numerals refer to similar parts throughout the drawings.

DETAILED DESCRIPTION OF THE INVENTION

Figure 3:
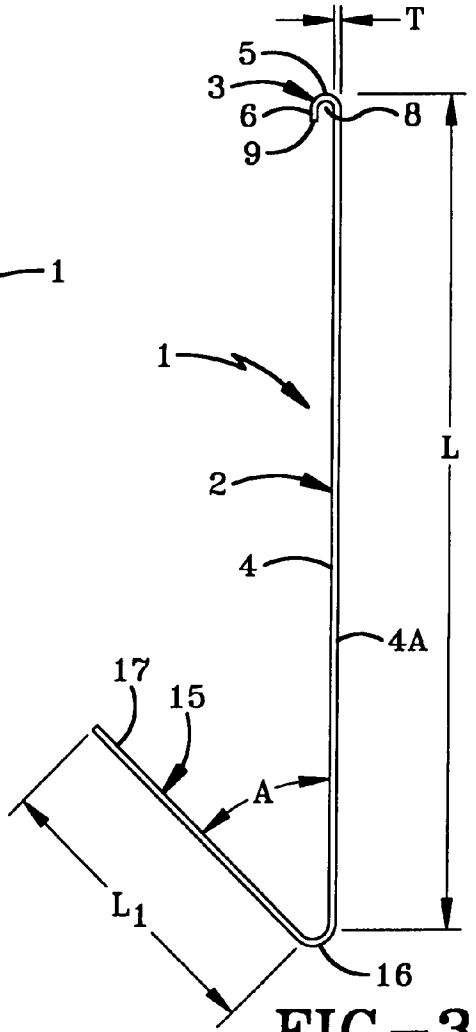
FIG. 3 is a right side elevational view of FIG. 2.
Figure 2:
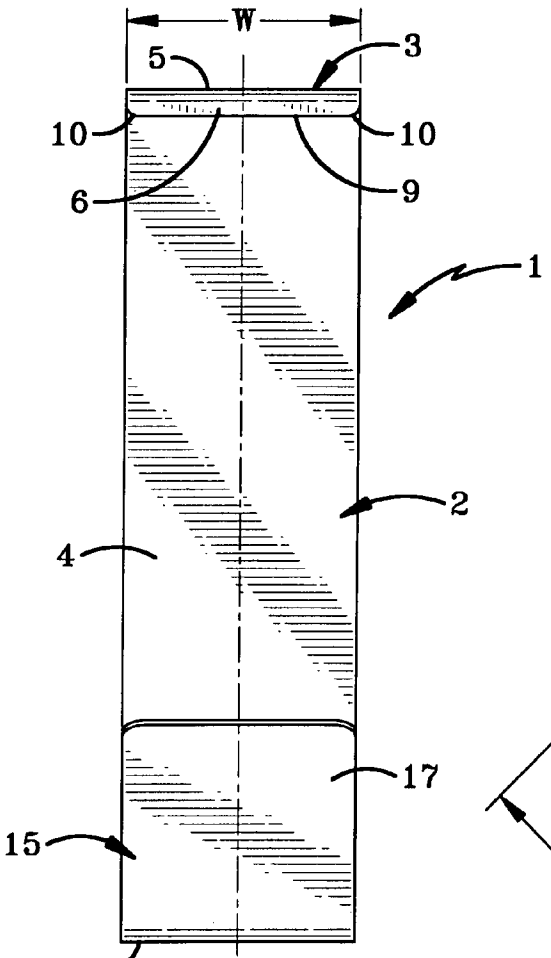
FIG. 2 is a front elevational view of the bracket of FIG. 1.
Figure 1:
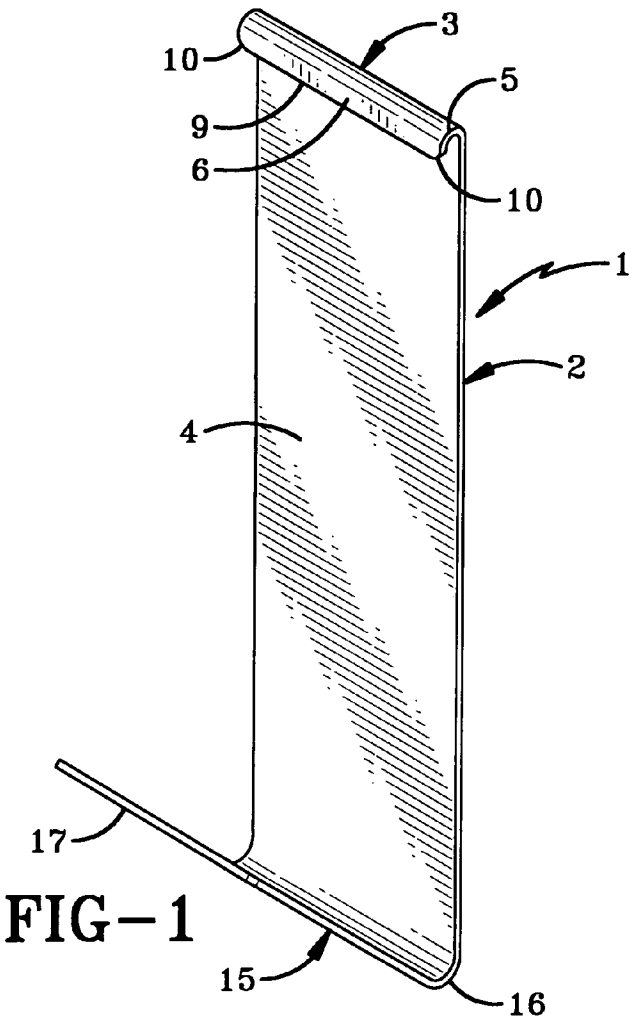
FIG. 1 is a perspective view of the bracket of the present invention.
Figure 4:
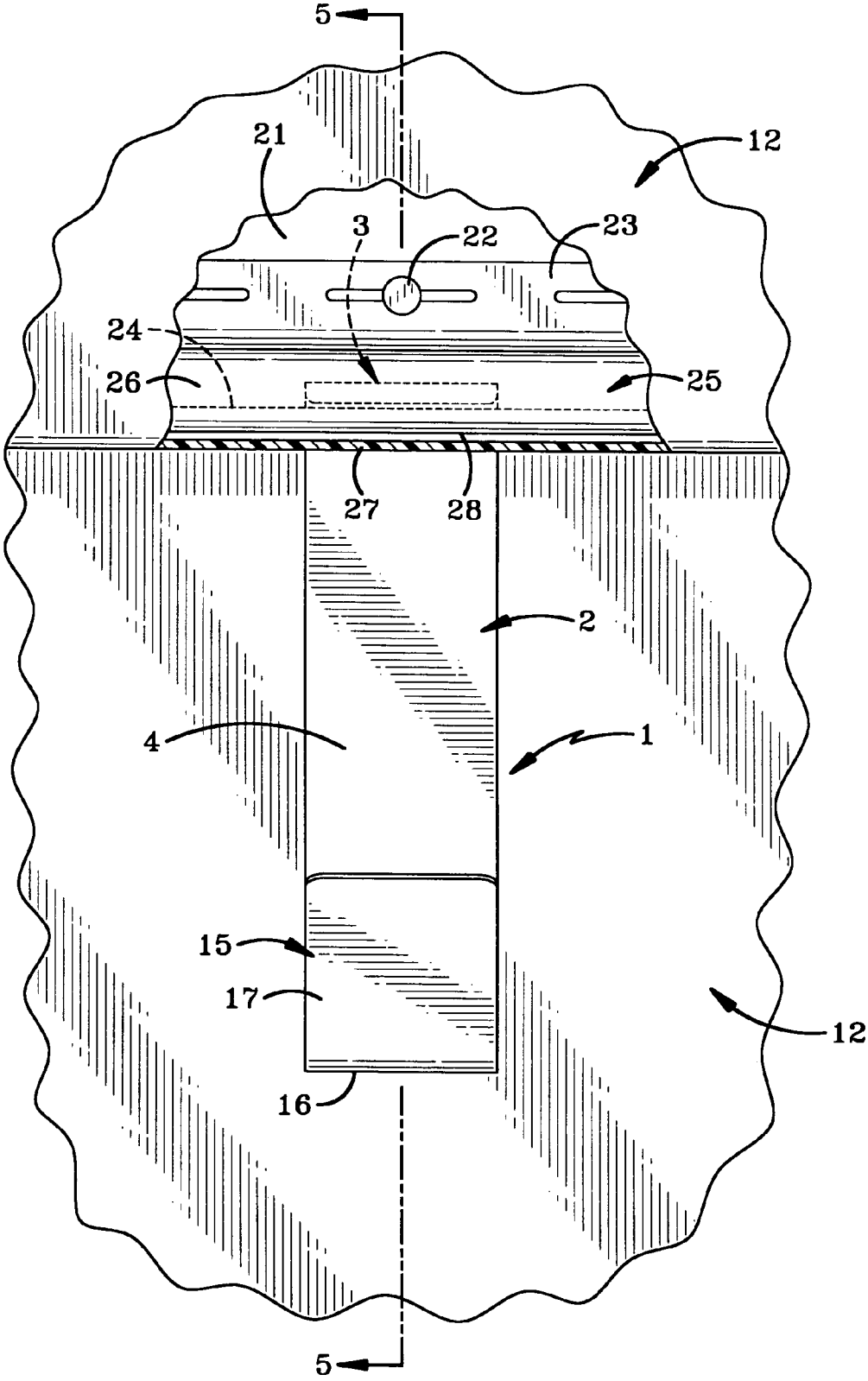
FIG. 4 is a front elevational view showing the bracket of FIG. 1 mounted on a longitudinal extending vinyl siding member.
Figure 5:
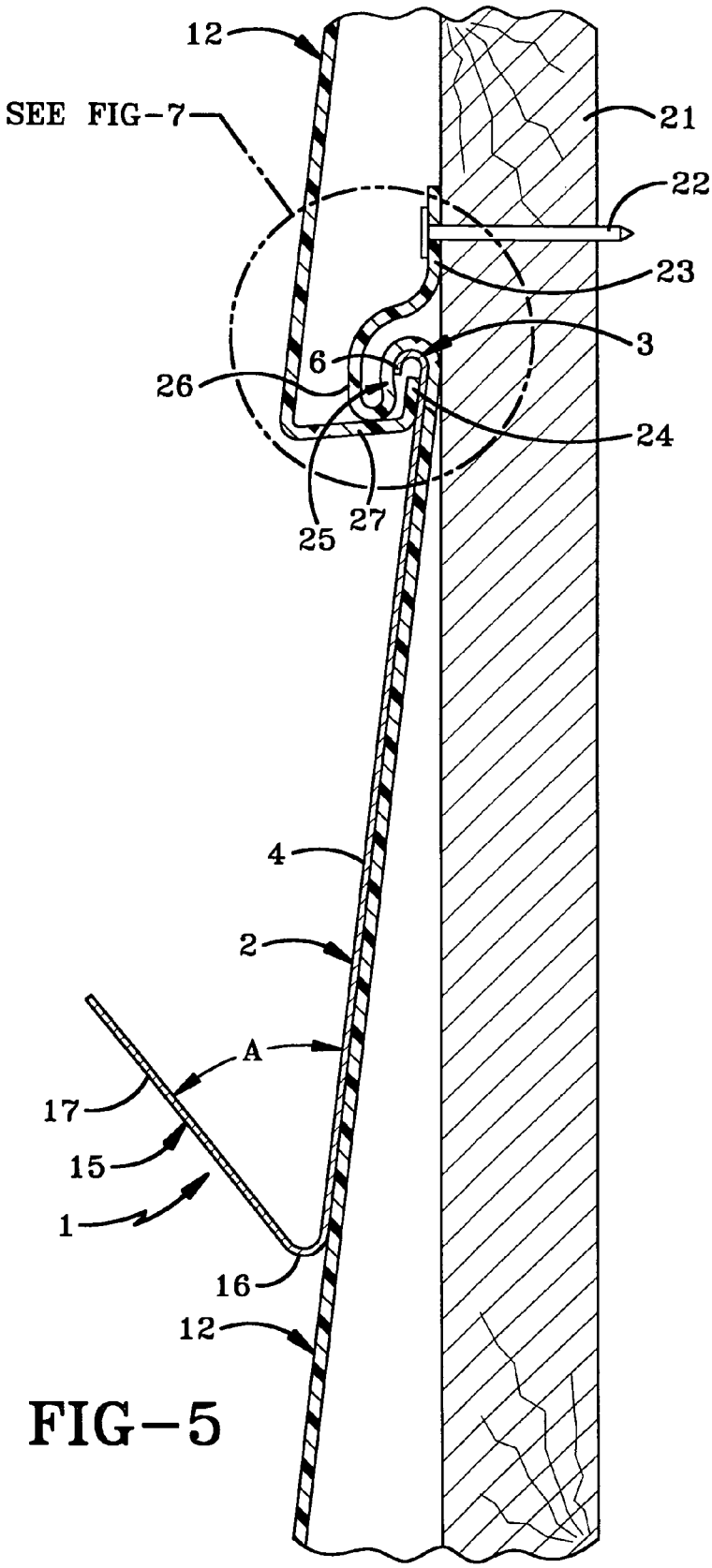
FIG. 5 is a sectional view taken on line 5—5, FIG. 4.
Figure 6:
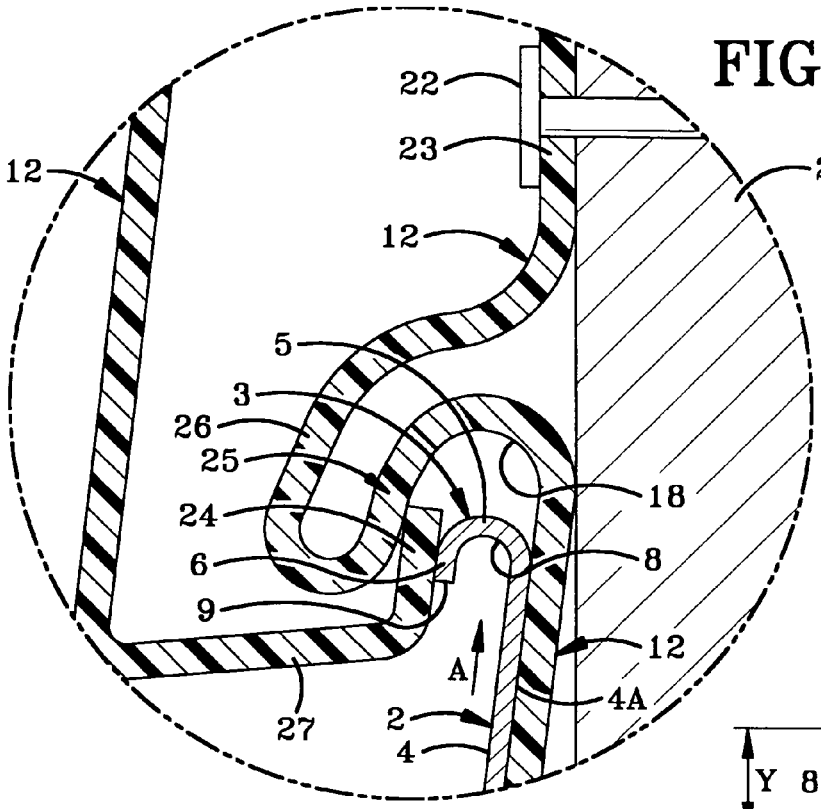
FIGS. 6 and 7 are enlarged fragmentary sectional views of the encircled portion of FIG. 5 showing the manner of attaching the bracket to the vinyl siding member.
Figure 6A:
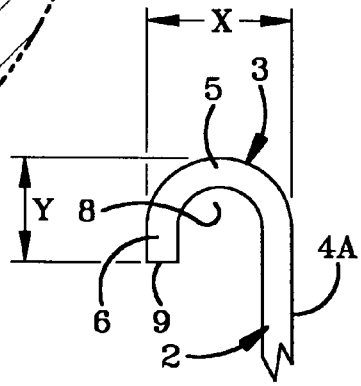
FIG. 6A is an enlarged fragmentary view of the downturned lip portion of the bracket.

A first embodiment of the bracket of the present invention is indicated generally at 1, and is shown particularly in FIGS. 1–7. Bracket 1 includes a main generally flat planar body 2 having front and rear surfaces 4 and 4A, respectively, and terminating at an upper end 3 which is in the form of a downturned lip which includes a web wall 5 and a downwardly extending lip 6. Lip 6 is spaced from and parallel with front surface 4 of main body 2 as shown in FIGS. 3 and 6A, providing a U-shaped slot 8 therebetween. Lip 6 terminates in an edge 9 which extends across the width of body 2, and in accordance with one of the features of the invention terminates in radiused or curved rounded end edges 10. This rounded edge configuration has been found to greatly facilitate the insertion and removal of the bracket and in particular, upper end 3 thereof, from a longitudinal edge of a siding member 12, as shown in FIGS. 4–7 and discussed further below.

The opposite or bottom end of bracket 1 includes a support hook indicated generally at 15, which includes a curved web 16 and an upwardly extending angled leg 17. Leg 17 forms an acute angle A with respect to front surface 4 of main body 2, as shown in FIG. 3, which is within the general range of 30° and 55°, with a preferable angle being approximately 45°.

In the preferred embodiment, bracket 1 is formed of stainless steel material such as stainless 302, having a 20 gauge with a width W of approximately 1.25 inches and a length L of approximately 4.6 inches, with bracket leg 17 having a length L, of approximately 1.5 inches. These dimensions and particular material has been found to provide the desired rigidity and strength, enabling bracket 1 to support various types and weights of objects on hook 17 without losing its supporting angle A or deforming the bracket. However, these parameters, although preferred, may vary without effecting the concept of the invention.

In accordance with one of the main features of the invention, downturned lip 6 (FIG. 6A) is spaced from rear surface 4A of body 2 a distance X, a distance which is complementary to the internal spacing of an inverted channel 18 (FIGS. 6 and 7) formed by an inwardly curved leg 25 of siding member 12, which extends from a longitudinally extending nailing flange 23 by a curved portion or leg 26. This reversely curved portion formed by legs 25 and 26 provides stiffness to the siding member for receiving an upturned leg 24 formed on the end of a straight leg portion 27 at the bottom of the upper adjacent siding member in a usual overlapping siding installation. Leg 24 extends into channel 18 and leg portion 27 abuts the bottom of curved portion 26 to form the standard interlocking engagement of adjacent vinyl siding members.

Figure 7:
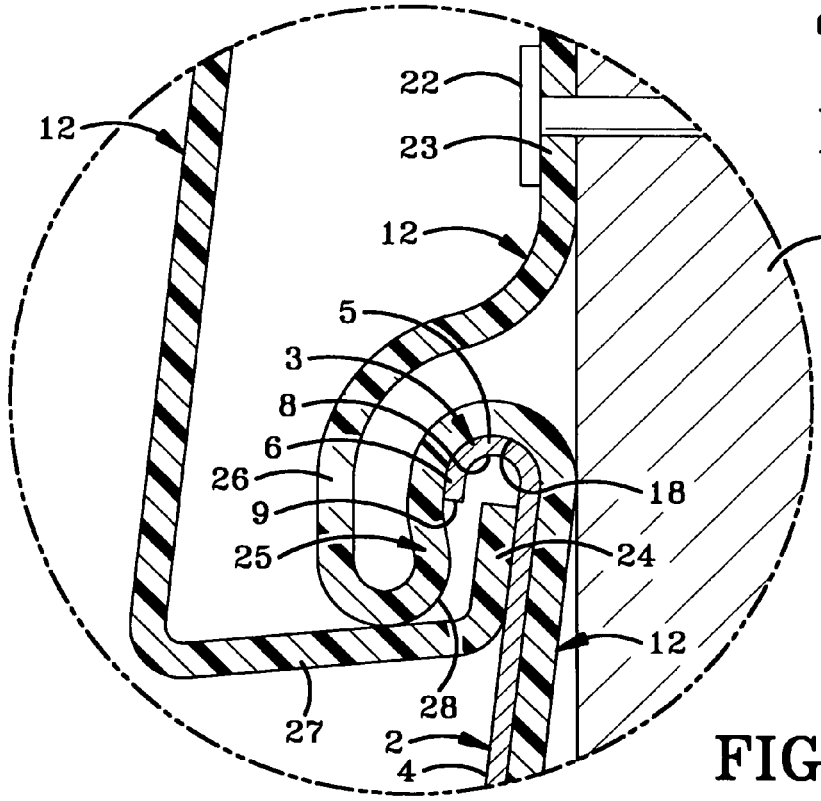

The manner of using bracket 1 is shown particularly in FIGS. 4–7, which shows a pair of longitudinally extending vinyl members 12 which are secured to a supporting wall 21 by a nail 22. Bracket 1 is installed by moving it upwardly in the direction of arrow A (FIG. 6) which will slide past leg 24 and snap into engagement within inverted channel 18 of siding member 12 just below nailing strip 23. The particular curved shape of the vinyl siding adjacent nailing strip 23 by curved portion 26 and channel 18 provides rigidity at the nailing area, and the inwardly curved portion of downturned leg 25, which forms channel 18, snaps back into its normal at-rest position as shown in FIG. 7 after lip 6 has been inserted into channel 18. This forms a solid locking engagement with lip 6, preventing the bracket from being pulled outwardly from its snap-fit engagement in channel 18. Upturned leg 24 will extend upwardly toward U-shaped channel 8 formed by lip 6 to provide a safety stop should lip 6 become disengaged prematurely from its snap-fit engagement within channel 18. However, the particular configuration of lip 6, as shown in FIG. 6A, which is complementary to the internal shape of channel 18, in combination with the inwardly curved portion of flexible leg 25, securely retains lip 6 therein, as shown in FIG. 7, to provide the ability of bracket 1 to support a load at its opposite end. Also, this arrangement prevents force from being exerted on leg 24 at the lower end of the upper adjacent vinyl siding member 12 by bracket 1 and the supported weight pulling it away from the adjacent lower siding panel as occurs in certain types of prior art vinyl siding hanging brackets.

Many types of vinyl siding panels or members have this curved configuration formed by leg portions 25 and 26 and channel 18 adjacent nailing flange 23, which have a standard dimension enabling bracket 1 to be compatible therewith. In the preferred embodiment, distance X, as shown in FIG. 6A, will be 0.179 inches, with dimension Y being 0.132 inches. These dimensions have been found to provide the desired snap-fit engagement with the curved area just beneath the nailing flange 23. As shown in FIG. 7, the slightly inwardly curved portion 28 of leg 25 will retain lip 6 in a secured position within channel 18.

In accordance with another feature of the invention, it has been found that radiused edges 10 greatly facilitate the insertion and removal of bracket 1 with respect to curved leg 25, without damaging the vinyl siding members. Without the radiused ends 10, the edges of similar bracket legs would bind or dig into the surrounding vinyl material, making the installation, and especially removal of the bracket therefrom, considerably more difficult and damaging to the siding.

Figure 8:
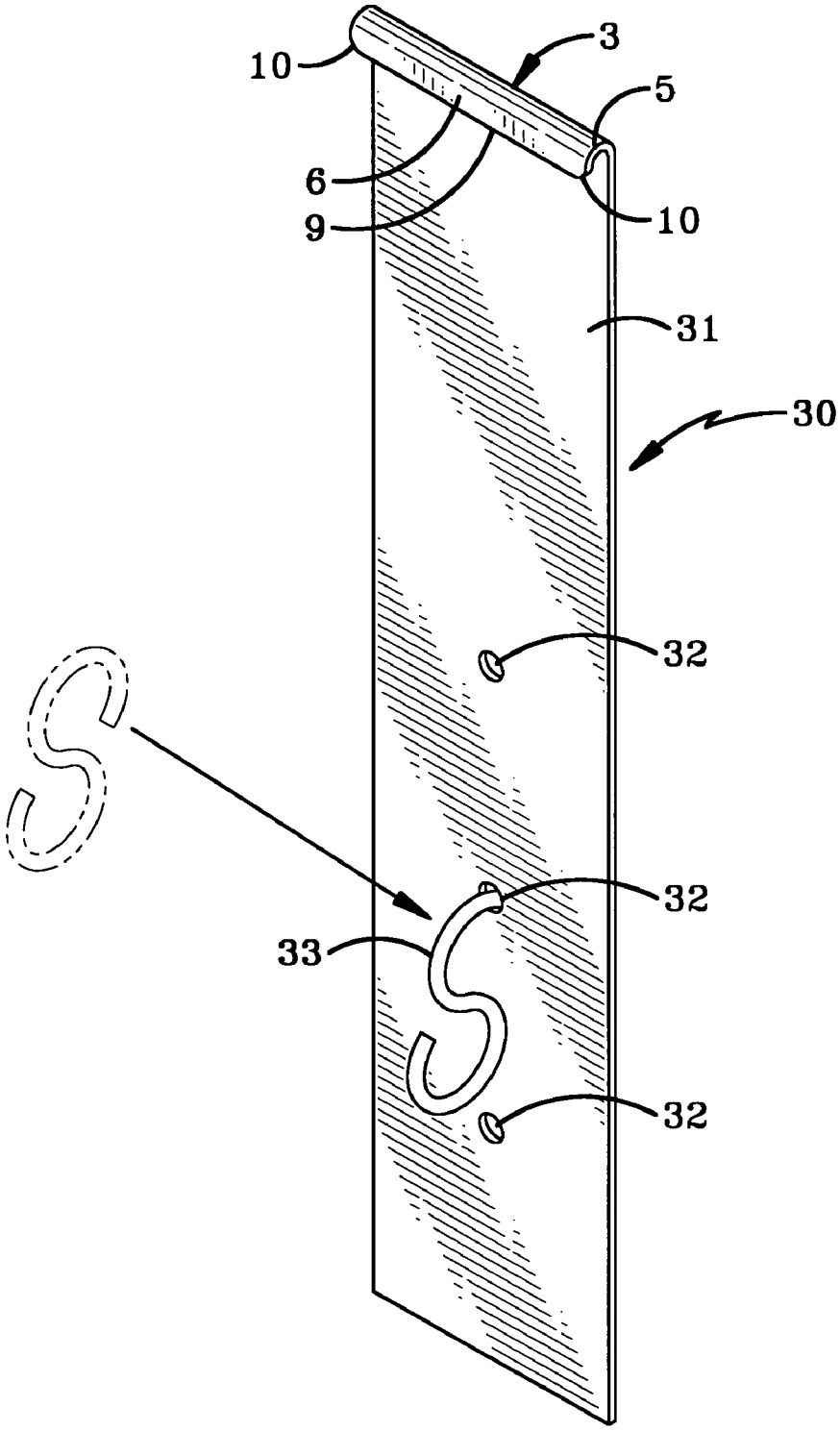
FIG. 8 is a perspective view showing a second embodiment of the improved vinyl siding bracket.

A second embodiment of the vinyl siding bracket is shown in FIG. 8 and is indicated generally at 30. Bracket 30 includes a main flat planar body 31, similar to body 2 discussed above, and has the same upper end 3 discussed previously. In this embodiment, hook 15 is replaced with one or more holes 32 in body 31 into which an S-shaped hook 33 or other type of support member, is removably inserted for subsequently suspending an object on bracket 30. Again, the same type, size, and material is used for bracket 30 as for bracket 1 discussed above.

Figure 9:
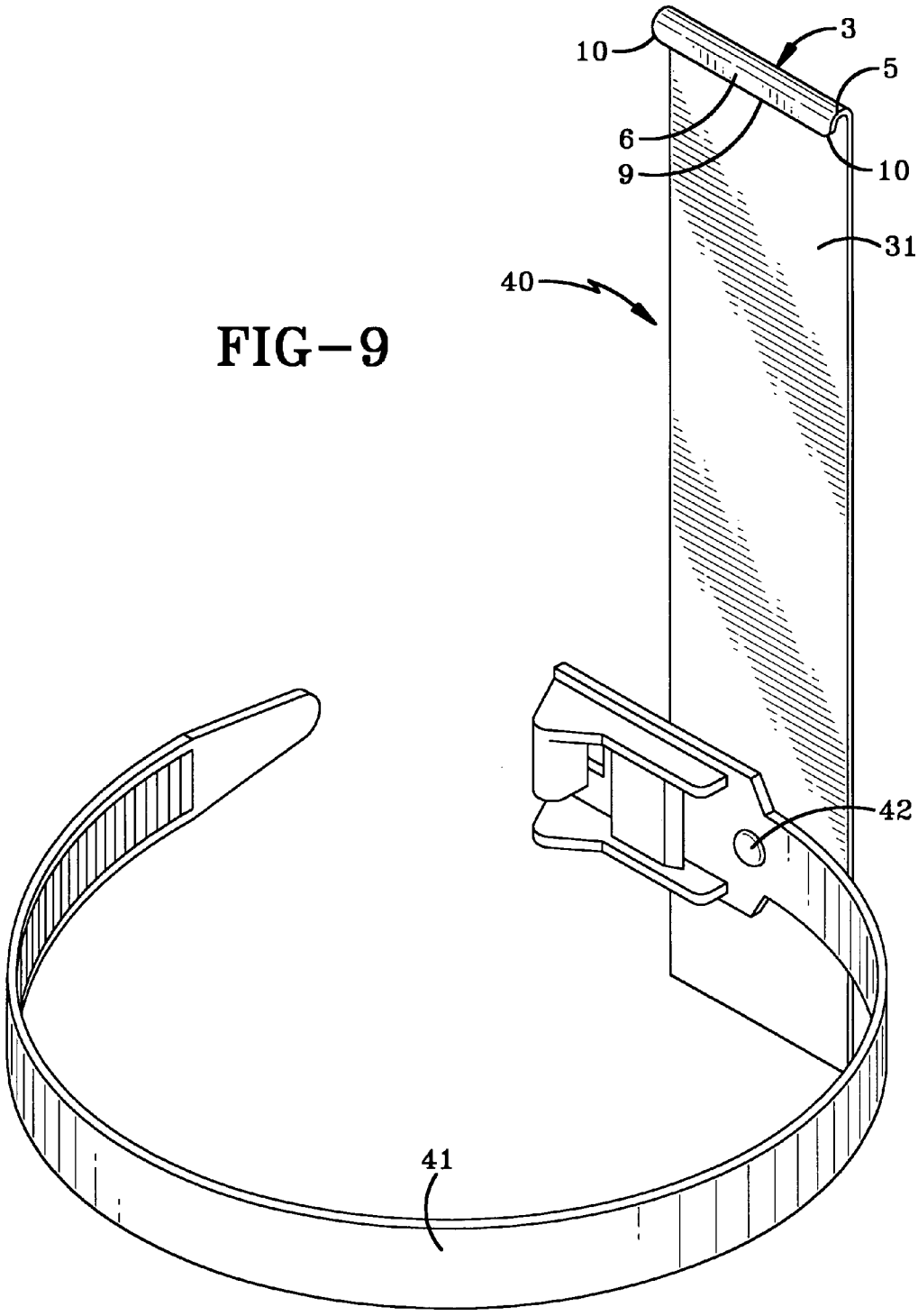
FIG. 9 is a perspective view of a third embodiment of the improved vinyl siding bracket.

Another embodiment of the improved bracket is shown in FIG. 9 and is indicated generally at 40. Bracket 40 is generally similar to bracket 30, discussed above, in that it has no support hook 15 at its lower end, but instead, uses an adjustable strap 41, preferably formed of flexible plastic, which is secured to bracket 40 by a rivet 42 or other type fastener. Strap 41 can support various types of items such as a tapered flower pot, or similar object. Again, the upper end of body 31 is formed with the same unique upper end 3 as discussed previously for snap-fit engagement with the curved stiffening area of the vinyl siding member adjacent nailing flange 23.

In summary, the improved bracket of the present invention provides an easily formed one-piece member formed of stainless steel, which has sufficient rigidity for supporting objects on vinyl siding, in which the upper end of the generally flat planar main body is formed with a downturned lip having radiused ends to facilitate the insertion and removal of the bracket on and from overlapped vinyl siding; and which has a configuration complementary to an inverted channel formed in many types of vinyl members to provide for a snap-fit engagement therebetween. This snap-fit engagement places the weight of the supported object at the reinforced stiff area of the siding member avoiding it from being exerted on the more flexible, less stiff lower end thereof.

The dimensions and types of material for bracket 1 set forth above have been found to provide a very satisfactory strong bracket which can be mass produced relatively inexpensive for numerous uses for suspending objects from vinyl siding in a relatively simple and efficient manner.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A one-piece bracket for attaching to longitudinally extending overlapping vinyl siding members for hanging objects therefrom, said bracket comprising:

a main generally flat planar rigid body having front and rear surfaces and terminating in a first end adapted to snap-fit engage one of the vinyl siding members, and a second end opposite of said first end for receivably supporting an object thereon;

said first end having a web extending from the main body and terminating in a rigid downturned planar lip spaced from and extending generally parallel with the front surface of said main body and forming a generally U-shaped slot between said lip and said front surface to provide for the snap-fit engagement of said first end with a complementary shaped inverted channel formed in said one siding member, said lip terminating in radiused ends to facilitate attachment of the first end of the bracket to one of the siding members; and said second end including a support connected to the main body and extending outwardly from the front surface for supporting an object on said main body.

2. The bracket defined in claim 1 wherein the support is a hook formed integrally with the main body and extending outwardly at an acute angle from the front surface of said body.

3. The bracket defined in claim 2 wherein the bracket is a one-piece member formed of stainless steel having a uniform thickness throughout of approximately 0.0355 inches.

4. The bracket defined in claim 2 wherein the support hook has a width equal to the width of the main body.

5. The bracket defined in claim 2 wherein the support hook has a length of approximately 1.5 inches.

6. The bracket defined in claim 2 wherein the acute angle of the hook with respect to the front surface of the main body is in the range of 30° and 55°.

7. The bracket defined in claim 1 wherein the support includes a plurality of holes formed in the main body and spaced along a central longitudinal axis of said body, and an S-hook is inserted into a selected one of said holes.

8. The bracket defined in claim 1 wherein the support includes an adjustable strap attached to the main body generally adjacent the second end thereof.

9. The bracket defined in claim 1 wherein the main body has a length of approximately 4.6 inches.

10. The bracket defined in claim 1 wherein the downturned lip is spaced a distance X from the main body of approximately 0.179 inches and has a length Y of approximately 0.132 inches.

11. In combination first and second overlapping vinyl siding members secured to a support structure and a bracket mounted on the first siding member for supporting an object thereon; said first siding member having an attachment flange and an inverted channel formed generally adjacent said attachment flange; said bracket having a main body terminating in first and second ends, said first end having a downturned lip complementary to the inverted channel of the first siding member and snap-fitted into said channel for mounting the bracket on said first siding member; and a support on the main body of the bracket for supporting an object on said body.

12. The combination defined in claim 11 wherein the support includes a plurality of holes formed in the main body and spaced along a central longitudinal axis of said body, and an S-hook is inserted into a selected one of said holes.

13. The combination defined in claim 11 wherein the support includes an adjustable strap attached to the main body generally adjacent the second end thereof.

14. The combination defined in claim 11 wherein the downturned lip is spaced from the main body a distance of approximately 0.179 inches and has a length of approximately 0.132 inches.

15. The combination defined in claim 11 wherein the support is a hook formed integrally with the main body and extends outwardly at an acute angle from said body.

16. A method of suspending an object from overlapping siding members attached to a structure comprising the steps of:

providing a bracket having a main generally flat planar rigid body with front and rear surfaces terminating at one end in a rigid curved web wall and a rigid downturned planar lip spaced from and extending along said front surface providing a U-shaped slot therebetween;

inserting the lip upwardly between a pair of overlapping siding members; and snap-fit engaging the lip and curved web wall into a complementary shaped inverted channel formed in one of the siding members.

17. The method defined in claim 16 including the steps of providing a plurality of holes in the main body; and inserting a hook in a selected one of said holes for supporting an object thereon.

18. The method defined in claim 16 including the steps of attaching an adjustable strap on the main body; and securing the strap about an object for supporting the object on the body.

19. The method defined in claim 16 including the step of forming the main body as a one-piece stainless steel member.

20. The method defined in claim 16 including the steps of forming the siding members of vinyl.

21. The method defined in claim 16 including the step of providing an angled leg extending outwardly from a second end of the main body and forming an acute angle with the front surface of said main body for supporting an object thereon.

* * * * *